US005777535A

United States Patent [19]

Farfoud et al.

[11] Patent Number: 5,777,535

[45] Date of Patent: Jul. 7, 1998

[54] COAXIAL CABLE WITH INTEGRATED GROUND DISCHARGE WIRE

[75] Inventors: Simon H. Farfoud; Robert W. Nunn, both of Jackson, Miss.

[73] Assignee: Triology Communications Inc., Pearl, Miss.

[21] Appl. No.: 651,023

[22] Filed: May 21, 1996

[51] Int. Cl.[6] ..... H01P 3/06

[52] U.S. Cl. ..... 333/243; 174/41

[58] Field of Search ..... 333/243, 215; 343/905; 174/28, 41, 70 A, 96, 115; 361/117

[56] References Cited

U.S. PATENT DOCUMENTS

| | | | |
|---|---|---|---|
| 3,328,510 | 6/1967 | White | 174/41 |
| 4,570,477 | 2/1986 | Sugibuchi | 174/115 X |
| 4,871,883 | 10/1989 | Guiol | 333/243 X |

*Primary Examiner*—Paul Gensler
*Attorney, Agent, or Firm*—Rader, Fishman & Grauer PLLC

[57] ABSTRACT

A coaxial cable comprising a coaxial portion, an integrally formed messenger wire and an integrally formed antenna ground discharge wire is disclosed. The two additional wires are encased in webs formed from the same material used to jacket the coaxial member.

14 Claims, 1 Drawing Sheet

COAXIAL CABLE WITH INTEGRATED GROUND DISCHARGE WIRE

BACKGROUND

The present invention relates to coaxial cables for transmission of video signals and the like. More particularly, it concerns a coaxial cable having both a messenger wire as well as an integrally formed antenna ground wire.

Antennas are often provided with ground discharge wires to discharge static charge build-up. The ground discharge wires also serve to protect electrical circuitry connected to the antenna from lightning strikes and other electrical disturbances. Most often, both a signal-carrying coaxial cable, as well as a separate ground discharge wire is connected to the antenna and the supporting mast or structure. This, however, is not always desirable in certain settings, especially those concerning wireless cable transmission and reception.

SUMMARY OF THE INVENTION

The present invention is directed to a coaxial cable having both an integrally formed messenger wire and a ground discharge wire. The wires are individually encased in an integrally formed jacket connected to the main cable jacket via the extruded web sections. In a preferred embodiment, the wires are diametrically opposite each other.

DETAILED DESCRIPTION OF THE INVENTION

Figure 1:
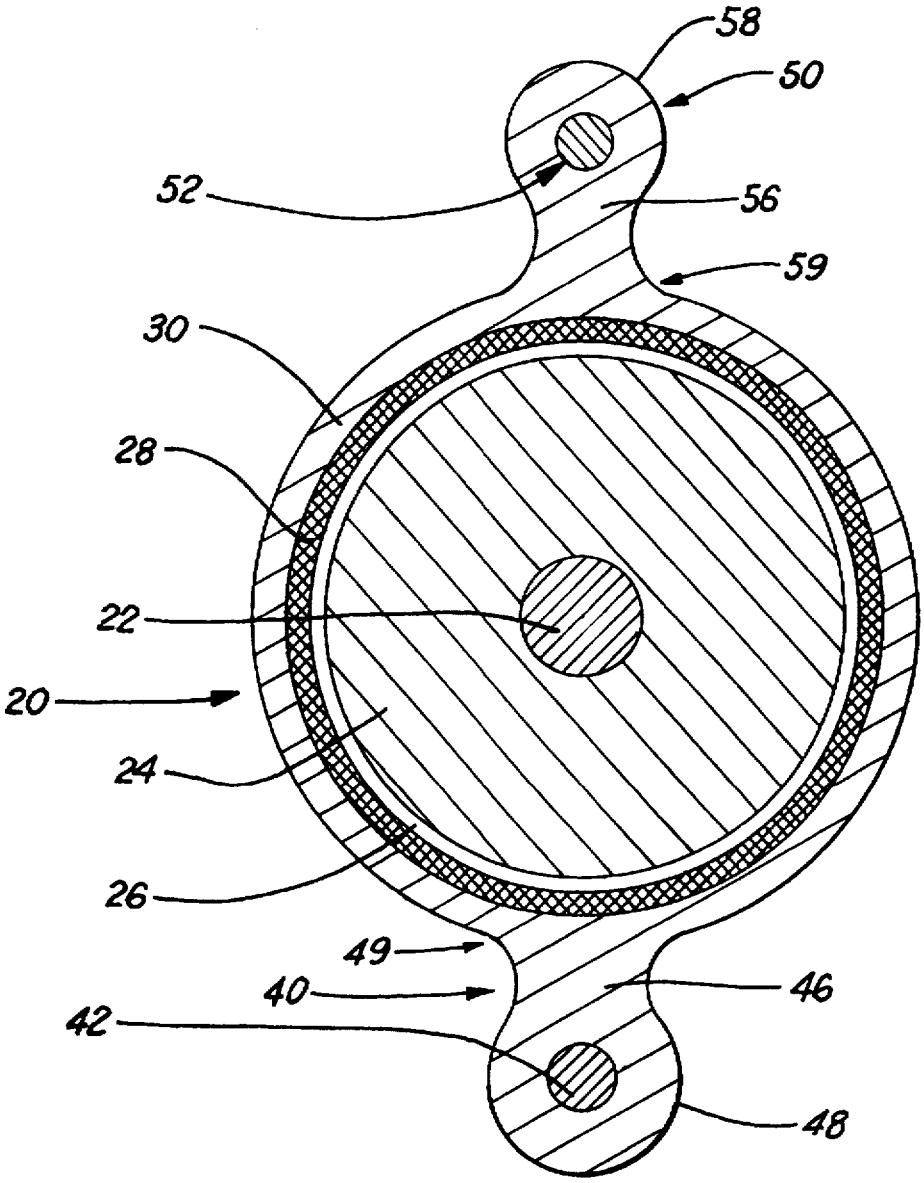
FIG. 1 is a cross-sectional view of the coaxial cable in accordance with the present invention.

Referring to FIG. 1, a cable 10 in accordance with the present invention comprises a coaxial member 20, a messenger member 40 and a grounding member 50.

The coaxial member comprises a metallic conductor 22 at its core. While a copper-cladded steel conductor is preferred, any type of conductive alloy, solid, hollow, stranded, corrugated or cladded will suffice.

In the preferred embodiment, a low loss gas expanded polyethylene dielectric insulation 24 is bonded to the center conductor using either heat or adhesive technology. However, solid, air and foamed dielectrics can all be used. The important property is that the dielectric material be suitable for manufacturing Radio Frequency (RF) cables.

A thin layer of center conductor adhesive formed from an EAA base is used to bond the dielectric insulation to the center conductor. Preferably, the adhesive is formed from a dielectric material having a dielectric constant similar to that of the dielectric insulation.

The dielectric 24 is covered by an outer conductor before a jacket 30 is applied. In the preferred embodiment, the outer conductor is formed from aluminum-polypropylene-aluminum 26 tape (APA). The tape is wrapped around the dielectric with a minimum of 18% overlap and then bonded thereto. The jacket can be formed from a variety of non-conductive compounds typically used to jacket RF cables. Preferably, a black PVC jacket, which provides both ultraviolet protection and good handling characteristics is used. As is known to those skilled in the art, the jacket can also be formed from polyethylene, TEFLON® and other compounds. The jacket may also be color coded and striped to identify the size or electrical characteristics of the cable.

Alternatively, as shown in FIG. 1, an outer shield 28 may also be used. The outer shield is placed around the APA tape. The shield is a metallic conductor. It can be either solid, corrugated or overlapped. It is not necessary that shield 28 be laminated or bonded. In the preferred embodiment, the outer shield comprises #34 AWG bare aluminum wire braid providing a coverage of between 59% and 100%. As shown in FIG. 1, the PVC jacket 30 is applied over the wire braid. It should be kept in mind, however, that the outer shield can be any type of metallic conductive alloy, be it braided, solid, or a hybrid of conductive tape and wire braid. Flooding and/or corrosion-inhibiting compounds may also be applied to the outer shield for added protection.

The messenger member 40 comprises a steel messenger wire 42 encased in a body 48 attached to the coaxial member 20 by a first web 46. The body 48 and web 46 are formed from the same material used to jacket the coaxial member 20. The messenger wire 42 may be either solid or stranded. Although different sized wires may be used, it preferably has a diameter between 0.06" and 0.08".

As shown in FIG. 1, the first web 46 has a wedge-shaped cross-section. The web 46 is attached to the coaxial member at the former's narrow end 49. This facilitates peeling the messenger member 40 away from the coaxial member 20, as may be required when forming terminal connections. The web 46, may, instead, have rectangular, square, circular and other cross-sectional shapes.

The body 48 of the messenger member 40 has a circular cross-section. The messenger wire 42 is encased in the body 48. Preferably, the body 48 and web 46 are formed at the same time and from the same materials as the jacketing material used on the coaxial member 20.

The construction of the grounding member 50 is similar to that of the messenger member 40. The grounding member 50 has a ground discharge wire 52 encased in the body portion 58 of grounding member 50. The ground discharge wire 52 should be a minimum size of #17 AWG and is preferably either #14 or #16 AWG. This size is needed to provide sufficiently low resistance for conducting electrical discharges. The wire 52 can be either solid, stranded, or a combination of the two and should be formed from conductive materials that comply with standard National Electrical Code 810-20. These materials include aluminum, copper, copper clad steel, copper clad aluminum, and bronze.

As is the case with the messenger member 40, the grounding member 50 also has a web 56 with a wedge-shaped cross-section. Again, the web is attached to the coaxial member 20 at the former's narrow end 59. The grounding member 50, like the messenger member 40, is preferably formed from the same jacketing material used in the coaxial member.

As shown in FIG. 1, the messenger and grounding members are arranged diametrically opposite one another. This, however, is not an absolute requirement. They may be arranged around the coaxial member at angles less than 180° as well. Furthermore,-as shown in FIG. 1, the messenger and grounding wires are parallel to each other and also to the coaxial member.

The centers of the messenger and grounding wires can be differentially spaced from the center of the coaxial cable member, which forms the latter's longitudinal axis. And, as shown in FIG. 1, the encased messenger and grounding wires are separated from the coaxial cable member by a distance greater than their respective, encased diameters. Neither of these characteristics, however, is an absolute necessity to form a cable in accordance with the present invention.

While there has been described what is at present considered to be a preferred embodiment of this invention, it will be clear to those skilled in art that various changes and modifications may be made without departing from the invention which is intended to cover all such changes and modifications as fall within the true spirit and scope of the claims set forth hereunder.

What is claimed is:

1. An electrical cable comprising:

a coaxial cable member comprising at least a center conductor, dielectric insulation and an outer conductor, said outer conductor having a flooding compound applied for added protection, said member having a longitudinal axis and an outer jacket formed from a jacketing material;

a first wire formed from a conductive material and arranged parallel to said coaxial cable member and electrically isolated therefrom, a center of said first wire spaced apart from said longitudinal axis by a first distance, said first wire encased in a first portion of said jacketing material and attached to said coaxial cable member by a first web formed from said jacketing material; and a second wire arranged parallel to said coaxial cable member, a center of said second wire spaced apart from said longitudinal axis by a second distance, said second wire encased in a second portion of said jacketing material and attached to said coaxial cable member by a second web formed from said jacketing materials, wherein the cable is further adapted to carry a radio-frequency video signal.

2. An electrical cable according to claim 1 wherein said first conductive wire is between #17 and #14 AWG.

3. An electrical cable according to claim 2 wherein said coaxial cable member further comprises a metallic shield around the outer conductor.

4. An electrical cable according to claim 1 wherein said first and second distances are different.

5. An electrical cable according to claim 1 wherein said first and second wires are arranged 180° apart from one another around said coaxial cable member.

6. An electrical cable according to claim 1 wherein said first and second portions each have a circular cross-section.

7. An electrical cable according to claim 6 wherein said first and second webs each have a wedge-shaped cross section, a narrow end of each wedge-shaped cross-sectional web being attached to said coaxial cable member.

8. An electrical cable according to claim 1 wherein each of said first and second wires is separated from said coaxial cable member jacket by a distance greater its diameter.

9. An electrical cable comprising:

a coaxial cable member comprising at least a center conductor, dielectric insulation and an outer conductor, said outer conductor having a flooding compound applied for added protection, said member having a longitudinal axis and an outer jacket formed from a jacketing material;

a first wire formed from a conductive material and arranged parallel to said coaxial cable member and electrically isolated therefrom, a center of said first wire spaced apart from said longitudinal axis by a first distance, said first wire encased in a first portion of said jacketing material and attached to said coaxial cable member by a first web formed from said jacketing material; and a second wire arranged parallel to said coaxial cable member, a center of said second wire spaced apart from said longitudinal axis by a second distance, said second wire encased in a second portion of said jacketing material and attached to said coaxial cable member by a second web formed from said jacketing material, wherein the first and second portions each encase exactly one wire, and the cable is further adapted to carry a radio-frequency video signal.

10. An electrical cable according to claim 9 wherein said first conductive wire is between #17 and #14 AWG.

11. An electrical cable according to claim 9, wherein said coaxial cable member further comprises a metallic shield around said outer conductor.

12. An electrical cable according to claim 9, wherein said first and second portions each have a circular cross-section.

13. An electric cable according to claim 12, wherein said first and second webs each have a wedged-shaped cross-section, a narrow end of each wedge-shaped cross-sectional web being attached to said coaxial cable member.

14. An electrical cable according to claim 13, wherein each of said first and second wires is spaced from said coaxial cable member jacket by a distance greater than each wire's diameter.

* * * * *

UNITED STATES PATENT AND TRADEMARK OFFICE

CERTIFICATE OF CORRECTION

PATENT NO. : 5,777,535

DATED : Jul. 7, 1998

INVENTOR(S) : Farfoud et al.

It is certified that error appears in the above-identified patent and that said Letters Patent is hereby corrected as shown below:

Col. 3, Claim 1, line 30, the word "materials" should be --material--.

Signed and Sealed this

First Day of June, 1999

*Attest:*

*Attesting Officer*

Q. TODD DICKINSON

*Acting Commissioner of Patents and Trademarks*